United States Patent [19]

Pfeifer et al.

[11] 4,087,178

[45] May 2, 1978

[54] SHEET-HOLDING CASSETTE FOR COPYING MACHINE

[75] Inventors: Josef Pfeifer, Unterhaching; Günther Schnall, Eching; Klaus Aldenhoven, Unterpfaffenhofen; Hanns Blöchl, Unterhaching, all of Germany

[73] Assignee: AGFA-Gevaert, A.G., Leverkusen, Germany

[21] Appl. No.: 790,135

[22] Filed: Apr. 22, 1977

[30] Foreign Application Priority Data

Apr. 24, 1976 Germany ..... 2618089

[51] Int. Cl.[2] ..... G03B 27/58

[52] U.S. Cl. ..... 355/72; 354/278

[58] Field of Search ..... 355/72, 8, 50, 51, 11, 355/65, 66; 354/278; 271/242, 145, 163

[56] References Cited

U.S. PATENT DOCUMENTS

| | | | |
|---|---|---|---|
| 3,308,713 | 3/1967 | Miller | 355/72 |
| 4,017,181 | 4/1977 | Komaba et al. | 355/72 |

FOREIGN PATENT DOCUMENTS

| | | | |
|---|---|---|---|
| 1,157,740 | 7/1969 | United Kingdom | 355/72 |

*Primary Examiner*—Richard A. Wintercorn
*Attorney, Agent, or Firm*—Michael J. Striker

[57] ABSTRACT

A sheet-holding cassette for a copying machine is formed as a box containing a stack of copy sheets. This box is adapted to be held in the machine with the uppermost sheet of the stack engageable with the paper-advance roller of the machine. A slot is provided in the upper wall of this cassette as well as a guide next to this slot and a deflector in back of this slot so that an extra sheet can be slid along the upper wall of the machine and into the cassette to lie at least at its front edge on top of the stack of sheets in the cassette. Thus as the paper-advance roller is reciprocated down onto the stack it will pick up this extra sheet rather than the top sheet of the stack, allowing a copy to be made on a single extra copy sheet without having to reload the machine.

10 Claims, 2 Drawing Figures

SHEET-HOLDING CASSETTE FOR COPYING MACHINE

BACKGROUND OF THE INVENTION

The present invention relates to a coyping machine. More particularly this invention concerns a paper cassette for an electrostatic copier.

An electrostatic copying machine normally has a paper-supply location where a stack of copy sheets is held. A paper-advance element is displaceable toward and away from this location to move the uppermost sheet off the stack of copy sheets and advance it to the location where an electrostatic or other copy is made on the sheet.

It is known to provide such a machine with a paper-holding cassette of box shape which serves to hold the stack of paper copy sheets in the machine at the paper-supply location. Such a cassette greatly eases loading and unloading of the machine, and makes it possible very rapidly to change the type of copy sheet or paper being used.

It is frequently desired to feed a single extra sheet into the machine so as to form a copy on this extra single sheet. This is frequently done to copy on the back of a previously made copy, to copy on letterhead, on an office form, or on a paper of a particular color. In order to avoid the necessity of having to reload the entire machine, it is known to provide a copying apparatus with a separate feed mechanism that can receive this extra copy sheet and feed it to the paper-advance element. Thus the user need merely slide the extra sheet into a slot normally provided on the machine above the paper-supply location so as to make a copy on this extra sheet.

The above-described system has a considerable disadvantage that it greatly adds to the complexity of the copier. This extra mechanism increases the possibility of breakdown of the machine, increases the size of the machine, and makes the machine more expensive.

SUMMARY OF THE INVENTION

It is therefore an object of the present invention to provide in combination with a copying machine an arrangement for feeding a single sheet to the machine in a manner that overcomes the above-described disadvantages.

Another object is to provide an improved copy-sheet cassette for a copying machine.

These objects are attained according to the present invention in a copy-sheet cassette which is formed basically as a box shaped to hold a stack of copy sheets and adapted to be held in the copying machine at the paper-supply location with the stack engageable by the paper-advance element of the machine. An upper wall of the box extends over the stack, has a smooth upwardly turned surface, and is formed with a throughgoing elongated slot opening at the surface. A guide is provided on the upper surface so that an extra sheet can be slid on the surface and along the guide toward the slot in the surface. Finally a deflector is provided on the upper wall which is adjacent the slot and extends upwardly beyond the upper surface. Thus the sheet slid along the upper surface against the guide is deflected by the deflector through the slot into the box and onto the top of the stack of sheets in the box.

Thus an extremely simple arrangement allows a copying machine which uses a standard cassette to be set up so that a single extra sheet can be fed to the machine. No redesign of the machine is necessary at all; only the copy-sheet cassette need be replaced in order to gain this extra capability for an existing copying machine. Furthermore since such cassettes typically are tipped down after they are inserted into the machine, an empty space exists above each cassette which easily allows the user to slide an extra copy sheet along the top of the cassette and into the slot thereof.

According to yet another feature of this invention the box has a front side and a back side and the slot extends generally parallel to and between the sides. The guide extends generally perpendicular to the slot and therefore extends from the front side to the back side. The deflector extends backwardly toward the back side from the upper surface of the box and forms an acute angle with this upper surface. Thus the sheet slid along the guide is automatically fed into the slot at right angles to the slot and in the exactly correct position for pick-up by the paper-advance element.

In accordance with further features of this invention the upper wall of the box is formed as a removable cover and carries on its upper surface indicia which shows the proper position for the trailing edge of a sheet of paper being slide along the guide into the slot. Thus as long as a sheet of standard length is being used the user can very easily ascertain how far to push it into the slot so that it will be picked up at just the right location by the paper-advance element and properly passed through the copying machine. In this manner when, for instance, the cassette is loaded with legal-size paper the user can feed in a letter-size paper without having to reload the machine, and vice versa.

According to yet another feature of this invention the paper-advance element of the copying machine is a simple roller normally formed of elastomeric material having a high coefficient of surface friction. This roller is continuously rotated and is merely reciprocated into and out of contact with the uppermost sheet of the stack or an extra sheet lying thereon to displace the uppermost sheet from the stack. Such a paper-advance element is greatly less expensive than the vacuum-type lifters often employed, and is perfectly usable with the cassette according to this invention.

In accordance with yet another feature of this invention the cassette is formed at its front side with an elongated throughgoing hole parallel to the slot. The rollers of the paper-advance element engage through this slot with the uppermost sheet of the stack.

According to further features of this invention except for the hole at the front side for the paper-advance element and the slot, the cassette is completely closed so that it protects the paper from dust and humidity. The bottom wall of the box on which the stack of sheets rests is vertically displaceable and the copying machine is provided with a biasing arrangement that pushes this bottom wall up so that the uppermost sheet always lies at substantially the same level. Furthermore the bottom wall is provided parallel to and adjacent the back side of the box with an upstanding abutment against which the back edges of all of the sheets rest. This abutment may be displaceable along the bottom wall in order to adjust the cassette for different lengths of paper.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

Figure 1:
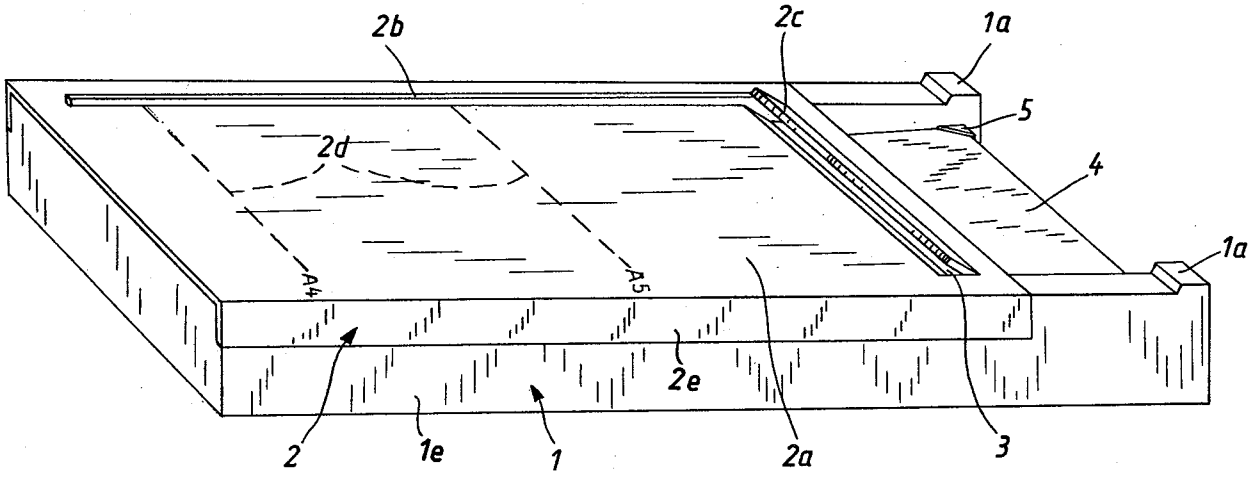
FIG. 1 is a perspective view of a cassette according to this invention.

DESCRIPTION OF A PREFERRED EMBODIMENT:

As shown in FIG. 1 a cassette according to this invention basically comprises a box 1 having a front open side 1*c*, a back wall 1*d* parallel to the open side 1*c*, a pair of parallel side walls 1*e*, and a bottom wall 1*f* formed with a throughgoing hole 1*b* adjacent the front side 1*c*. The side walls are formed adjacent the front end with upstanding projections 1*a*. The walls 1*d*, 1*e* and 1*f* are all planar and mutually perpendicular.

The box 1 has a cover 2 with an upper surface 2*a* and a pair of lateral downwardly extending side lips 2*e* that engage over the side walls 1*e*. Thus this cover is generally of downwardly open U-shape. The cover 2 is formed adjacent the front side 1*c* with a throughgoing slot 3 that extends substantially from one edge lip 2*e* to the other and perpendicular thereto. The rear edge of this slot 3 is formed by downwardly bent portion 2*f* and the front edge is formed by an upstanding deflector 2*c*. The entire lid 2 is formed unitarily and the formations 2*c*, 2*b* and 2*f* are integral therewith. In addition the upper surface 2*a* carrier indicia 2*d* which indicate the position for the trailing edge of a piece of paper fed into the cassette as will be described below.

Spaced above the bottom wall 1*f* of the box 1 is another bottom wall 6 having pivots 6*a* received in slots 7 at the rear end of the box 1. This support wall 6 is provided with an upstanding abutment 11 against which rests the rear edge of a stack 4 of copy sheets. The upper front edge of the stack of copy sheets is held by retainers 4 known in the art.

Figure 2:
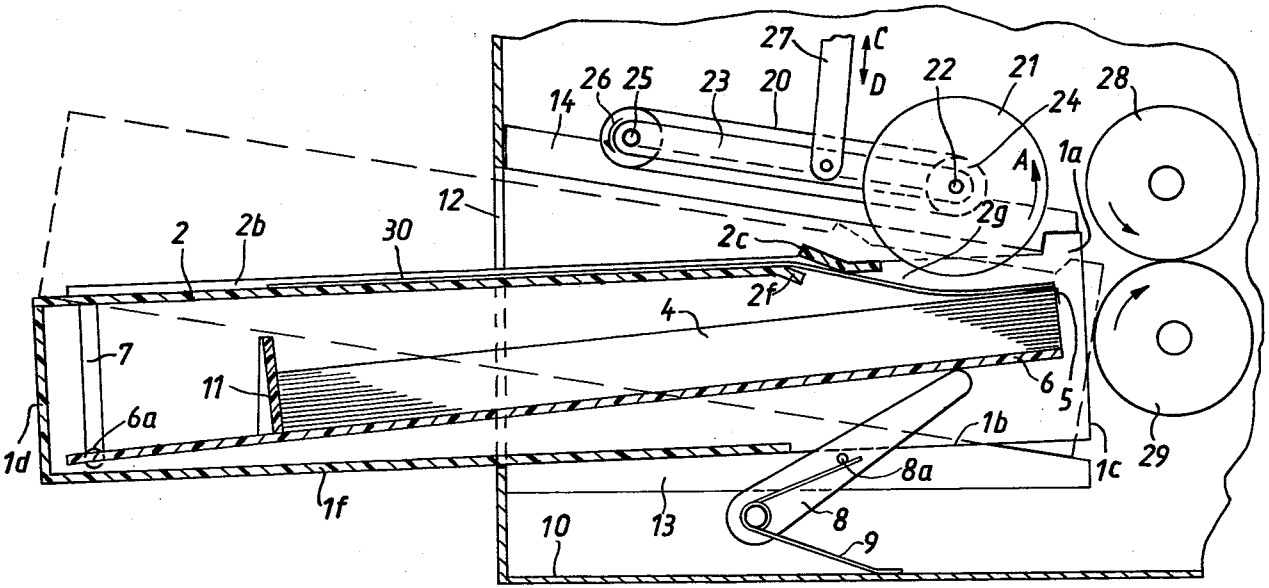
FIG. 2 is a vertical section through a portion of a copying machine and a cassette according to this invention.

The deflectable bottom wall 6 of the box 1 is biased upwardly into the position shown in FIG. 2 by a pawl arrangement 8 hinged on the housing 10 and biasing upwardly through the hole 1*b* in the box 1 by means of a torsion spring 9 bearing against a pin 8*a* on the pawl 8. Thus the upper front corner of the stack 4 is always in the same position held in corner retainers 5, regardless of the thickness of the stack 4.

FIG. 2 shows how the cassette is adapted to be fitted in a hole 12 in the vertical wall of a housing 10 of an electrostatic copier. The lower wall 1*f* is supported on lower rails 13 and upper rails 14 inclined to these rails 13 are provided with formations that snugly fit with the projections 1*a*. The cassette is slid into the housing in the dashed-line position of FIG. 2, that is with its lower front edge sliding along the rails 13 and its upper surface 2*a* parallel to the rails 14. Once it is all the way in place, the cassette is then dropped down so that it rests flatly on the rails 13 and the formations 1*a* fit with the rails 14. This leaves a space in the opening 12 above the upper surface 2*a*.

A paper-advance element constituted by a plurality of rollers 21 of elastomeric material mounted on a pivot 22 is carried on arms 23 pivoted at 25 on the housing 10. A drive wheel 26 pivoted on the axis 25 is continuously rotated and is connected via a toothed belt 20 to a wheel 24 connected to the axle 22 so that the pick-up rollers 21 all rotate continuously in the direction of arrow A. A link 27 connected to operating mechanism inside the machine is vertically reciprocal in the direction of double-headed arrow C–D so that the pick-up rollers 21 can be brought into contact with the uppermost sheet of the stack 4, passing through an elongated hole 2*g* in the top of the housing adjacent the cover 2. When these rollers 21 engage the topmost sheet they advance it to a pair of pinch rollers 28 and 29 that thereafter feed it through the electrostatic copying machine having housing 10.

When an extra sheet 30 is to be loaded into the machine the user need merely lay it on the surface 2*a* with its one side edge against the guide 2*b*. The user then slides the sheet 30 forwardly toward the deflector 2*c* which will deflect it down into the interior of the cassette and onto the top of the stack 4. The use then aligns the trailing edge with the appropriate indicia 2*d*, which indicate various paper lengths, so that the leading edge or the front edge of the extra sheet 30 will lie exactly level with the front edge of the stack 4. The next time the copier is operated and the link 27 moves the paper-advance elements 21 down in the direction D this extra sheet 30 rather than the topmost sheet in the stack 4 will be picked up.

It will be understood that each of the elements described above, or two or more together, may also find a useful application in other types of machines differing from the types described above.

While the invention has been illustrated and described as embodied in a paper-holding cassette, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, farily constitute essential characteristics of the generic or specific aspects of this invention.

What is claimed as new and desired to be protected by Letters Patent is set forth in the appended claims:

1. In combination with a copying machine having a paper-advance element and means for reciprocating said element toward and away from a paper-supply location, a copy-sheet cassette comprising:

a box shaped to hold a stack of copy sheets and adapted to be held in said machine at said location with said stack engageable by said paper-advance element;

an upper wall on said box extending over said stack, having a smooth upwardly turned surface, and formed with a throughgoing elongated slot opening at said surface;

a guide on said upper surface, whereby an extra sheet can be slid on said surface and along said guide toward said slot; and a deflector on said upper wall adjacent said slot and extending upwardly beyond said upper surface, whereby the sheet slid along said upper surface is deflected by said deflector through said slot into said box.

2. The combination defined in claim 1, wherein said box has a front side and a back side and said slot extends generally parallel to and between said sides, said guide extending generally perpendicular to said slot.

3. The combination defined in claim 2, wherein said deflector extends backwardly toward said back side from said surface and forms an acute angle with said upper surface.

4. The combination defined in claim 3, wherein said slot has a front edge defined by said deflector.

5. The combination defined in claim 2, wherein said upper surface carries indicia showing the position for the trailing edge of a sheet of paper being slid along said guide into said slot.

6. The combination defined in claim 2, wherein said upper wall is a removable cover for said box.

7. The combination defined in claim 2, wherein said upper wall is formed adjacent said front side with a throughgoing hole and said paper-advance element is engageable through said hole with the uppermost sheet of said stack.

8. The combination defined in claim 7, wherein said front side of said box is substantially open at said hole.

9. The combination defined in claim 7, wherein said hole is elongated and parallel to and spaced from said slot.

10. The combination defined in claim 1, wherein said paper-advance element is a continuously rotating roller.

* * * * *